US005389108A

United States Patent [19]

Fritzsche et al.

[11] Patent Number: 5,389,108

[45] Date of Patent: Feb. 14, 1995

[54] PROCESS FOR FIXING DYES

[75] Inventors: Katharina Fritzsche, Weil am Rhein, Germany; Martin Trottmann, Therwil, Switzerland

[73] Assignee: Ciba-Geigy Corporation, Ardsley, N.Y.

[21] Appl. No.: 914,157

[22] Filed: Jul. 14, 1992

[30] Foreign Application Priority Data

Jul. 17, 1991 [CH] Switzerland ..... 2120/91

[51] Int. Cl.[6] ..... D06P 1/38; D06D 5/20

[52] U.S. Cl. ..... 8/444; 8/405; 8/523; 8/543; 8/544; 8/549; 8/553; 8/555; 8/558; 8/647; 8/917; 8/926; 8/927; 8/928

[58] Field of Search ..... 8/444, 405, 568, 582, 8/586, 598, 611, 613, 647, 648, 661–663, 675, 685, 687, 916–928

[56] References Cited

U.S. PATENT DOCUMENTS 2,897,101 7/1959 Graulich .
4,588,411 5/1986 Scheibli ..... 8/528
5,238,465 8/1993 Fritzsche ..... 8/444

FOREIGN PATENT DOCUMENTS 0337951 10/1989 European Pat. Off. .
2632010 1/1978 Germany .
0388254 2/1965 Switzerland .
1316458 5/1973 United Kingdom .
1341199 12/1973 United Kingdom .

OTHER PUBLICATIONS

Park et al, "Elastomeric Radiation-Curable Binders for Textile Printing", Textile Chem & Col, vol. 11 pp. 107–113, May 1979.
C.A. 55-26458A (1961).
Chem Abstr 112:19989 (EP 337951) Oct. 1989.
Chem Abstr 88: 106961 (DE 262301) Jan. 1978.
Textile Chem & Col, vol. 10, pp. 220–224 Oct. 1978.
Metropolitan Section, vol. 2, #24, pp. 414–424 Dec. 1970.

*Primary Examiner*—Paul Lieberman
*Assistant Examiner*—Margaret Einsmann
*Attorney, Agent, or Firm*—Marla J. Mathias; George R. Dohmann

[57] ABSTRACT

The invention relates to a process for fixing dyes on organic material, which comprises fixing dyes containing at least one polymerizable double bond or at least one polymerizable ring system, excluding water-soluble dyes which carry acrylamido or methacrylamido groups, together with at least one substantially colorless compound which contains at least one polymerizable double bond, by subjecting said organic material, which has a residual moisture content of less than 20%, based on the treated material, to ionizing radiation.

23 Claims, No Drawings

PROCESS FOR FIXING DYES

The present invention relates to a process for fixing dyes on organic material, which comprises fixing dyes containing at least one polymerisable double bond or at least one polymerisable ring system, excluding water-soluble dyes which carry acrylamido or methacrylamido groups, together with at least one substantially colourless compound which contains at least one polymerisable double bond, by subjecting said organic material, which has a residual moisture content of less than 20%, based on the treated material, to ionising radiation.

It is known that dyes which contain activated unsaturated groups can be fixed on organic material, especially fibre material, by subjecting said material to ionising radiation. Compared to conventional processes for fixing dyes, especially reactive dyes, the distinguishing feature of radiation-induced fixation is that fixation baths and fixing agents can be completely avoided. The simultaneous application and fixation of dye and textile finishing agents, for example to improve antistatic properties, wrinkle resistance and to reduce soil retention, is seen as a further advantage.

Dyeing practice, especially with reactive dyes, and also with disperse dyes, has led in recent times to more exacting demands being made of the quality of the dyeing and the efficiency of the dyeing process. The fixation of reactive dyes by ionising radiation alone no longer meets current criteria with respect to the fixation to be effected. It is therefore the object of this invention to provide an improved fixation process which in addition has the advantages of radiation-induced fixation. It has been found that the novel process achieves this object.

Accordingly, the invention provides a process for fixing dyes on organic material, especially fibre material, which comprises fixing dyes containing at least one polymerisable double bond or at least one polymerisable ring system, excluding water-soluble dyes which carry acrylamido or methacrylamido groups, together with at least one substantially colourless compound which contains at least one polymerisable double bond, by subjecting said organic material, which has a residual moisture content of less than 20%, based on the treated material, to ionising radiation.

The distinguishing feature of the novel process is that dye and colourless compound are applied together, so that only a single dyebath or single dye liquor is necessary, thereby achieving a markedly higher degree of fixation than in the known processes without a colourless polymerisable compound. A further advantage of the novel process is that, in contrast to wet state radiation, less dye is destroyed, thereby resulting in greater brilliance of the dyeing. A further advantage of radiating dry material resides in the possibility of also being able to fix water-insoluble or very sparingly soluble dyes by means of the novel process.

Within the scope of this invention, dry organic material will be understood as meaning in particular fibre material which has a residual moisture content of less than 20%, preferably of 5–10%, based on the treated material before irradiation.

The novel process avoids a high concentration of auxiliaries and complicated apparatus, as after the fixation step fixing alkali does not need to be washed out: it is only necessary to rinse and dry the dyed or printed fibre material. Dispensing with fixing alkali not only limits the amount of wastewater compared to conventional processes, but also simplifies processing of the residual effluent.

The fixation process consists in subjecting organic material to be dyed, typically textile fibre material, after treatment with a dye which contains at least one polymerisable double bond or at least one polymerisable ring system, and in the presence of at least one colourless compound which contains at least one polymerisable double bond, in the dry state for a brief time to ionising radiation.

The treatment of the fibre material to be dyed with a dye as defined herein can be carried out by one of the standard methods. If the material is a textile fabric, then treatment is conveniently effected by impregnation with a dye solution in an exhaust bath or by spraying or padding with a pad liquor, or by printing on a roller printer. If sparingly soluble or water-insoluble dyes are used, a solution of the dye in a vinyl or acrylate binder can be applied by padding, spraying and the like. Such dyes can also be applied to the organic material by padding, spraying or printing an aqueous vinyl or acrylate emulsion of the dyes. If necessary, the organic material is dried after application to a residual moisture content of less than 20%.

Ionising radiation will be understood as meaning irradiation which can be produced in an ionising chamber. It consists either of electrically charged, directly ionising particles which, in gases along their path, produce ions by impact, or of uncharged, indirectly ionising particles or photons which produce directly ionising charged secondary particles, such as the secondary electrons of X-rays or $\gamma$-rays or the recoil nuclei (especially protons) of fast neutrons. Likewise indirectly ionising particles are slow neutrons which are able to produce energy-rich charged particles by nuclear reactions in part direct, in part via photons from $(\beta,\gamma)$ processes. Suitable heavy charged particles are protons, atomic nuclei or ionised atoms. Of particular importance for the inventive process are light, charged particles, for example electrons. Suitable X-ray radiation is both retardation radiation and characteristic radiation. Important particle radiation of heavy charged particles is typically $\alpha$-radiation.

The ionising radiation can be produced by one of the standard methods. Thus, for example, spontaneous nuclear transformations and also nuclear reactions (enforced nuclear transformations) can be used to produce ionising radiation. Suitable sources of radiation are natural or synthetic radioactive substances and, more particularly, atomic reactors. The radioactive fission products produced by nuclear fission in such reactors are a further important source of radiation.

A further possible method of producing radiation is that using a an X-ray tube.

Further ionising radiation is suitably vacuum UV light having a wavelength smaller than 200 nm and vacuum UV laser light (e.g. 193 nm).

Of particular importance are beams which consist of particles accelerated in electric fields. Suitable sources of radiation here are thermal, electron impact, low tension arc, cold cathode and high-frequency ion sources.

Electron beams are of particular importance for the inventive process. These are produced by acceleration and bunching of electrons which are triggered by thermionic emission, field emission or photoemission and also by electron or ion bombardment from a cathode.

Sources of radiation are electron guns and accelerators of conventional make. Typical sources of radiation are known from the literature, e.g. International Journal of Electron Beam & Gamma Radiation Processing, in particular 1/89 pages 11–15; Optik, 77 (1987), pages 99–104.

Sources of radiation for electron beams are also $\beta$-emitters such as strontium-90.

Suitable technically useful ionising beams are also $\gamma$-rays, which can be readily produced with caesium-137 or cobalt-60 isotope sources.

Dyes which may suitably be used for the novel fixation process are those which contain an activated unsaturated group, preferably an unsaturated aliphatic group, typically the vinyl, halovinyl, styryl, acryloyl or methacryloyl group. Exemplary of such groups are the halogen-containing unsaturated groups such as the halomaleic acid and halopropiolic acid groups, the $\alpha$- or $\beta$-bromo- or chloroacryloyl groups, halogenated vinylacetyl groups, halocrotonyl or halomethacryloyl groups. Also suitable are those groups which are readily converted to halogenated unsaturated groups, typically the dichloropropionyl or dibromopropionyl group. Halogen atoms will be taken to mean in this context fluorine, chlorine, bromine and iodine atoms as well as pseudo-halogen atoms, conveniently the cyano group. Good results are obtained by the inventive process with dyes which contain an $\alpha$-bromoacrylolyl group. Dyes which contain a polymerisable double bond are suitably those which contain at least one acryloyl, $\alpha$-bromoacryloyl, $\alpha$-chloroacryloyl or vinylsulfonyl radical. Dyes which contain a polymerisable ring system are preferably those which contain at least one epoxide radical.

The chromophoric systems used may belong to the most diverse classes of dye.

A preferred embodiment of the novel process comprises the use of dyes of formula $$D-(X)_m \quad (1),$$

wherein D is the radical of an organic dye of the monoazo or polyazo series, of the metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series, X is a polymerisable double bond or a polymerisable ring system, and m is 1, 2, 3, 4, 5 or 6.

A particularly preferred embodiment of the novel process comprises the use of water-soluble dyes of formula (1), conveniently those wherein a) D is the radical of a formazan dye of formula

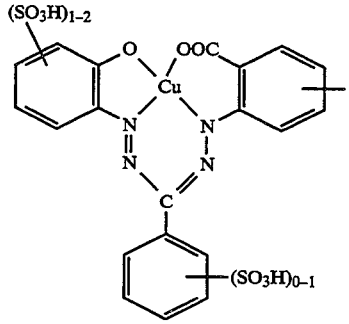

(2a)

-continued or

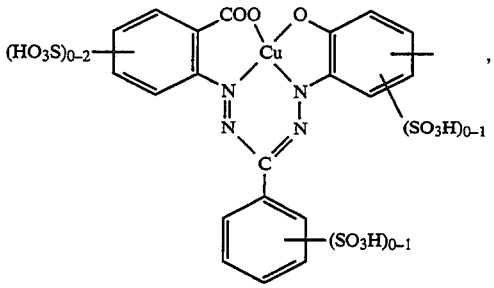

(2b)

wherein the benzene nuclei may be substituted by alkyl of 1 to 4 carbon atoms, alkoxy of 1 to 4 carbon atoms, alkylsulfonyl of 1 to 4 carbon atoms, halogen or carboxy, b) D is the radical of an anthraquinone dye of formula

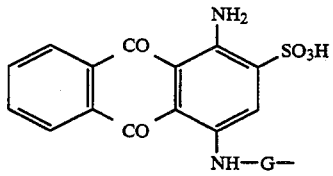

(3)

wherein G is a phenylene, cyclohexylene or $C_2$–$C_6$alkylene radical, the anthraquinone nucleus of which dye may be substituted by a further sulfo group and G as phenyl radical may be substituted by alkyl of 1 to 4 carbon atoms, alkoxy of 1 to 4 carbon atoms, halogen, carboxy or sulfo.

c) D is the radical of a phthalocyanine dye of formula

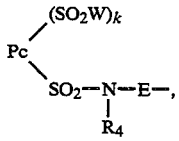

(4)

wherein Pc is the radical of a copper or nickel phthalocyanine; W is —OH and/or —$NR_5R_6$; $R_5$ and $R_6$ are each independently of the other hydrogen or alkyl of 1 to 4 carbon atoms which may be substituted by hydroxy or sulfo; $R_4$ is hydrogen or alkyl of 1 to 4 carbon atoms, E is a phenylene radical which may be substituted by alkyl of 1 to 4 carbon atoms, halogen, carboxy or sulfo; or is an alkylene radical of 2 to 6 carbon atoms, preferably a sulfophenylene or ethylene radical; and k=1, 2 or 3.

d) D is the radical of a dioxazine dye of formula

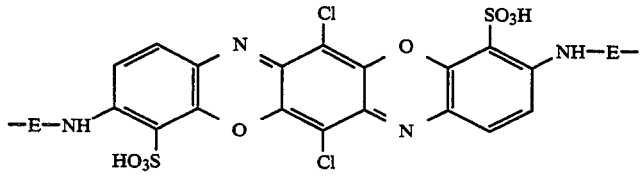

(5a)

or

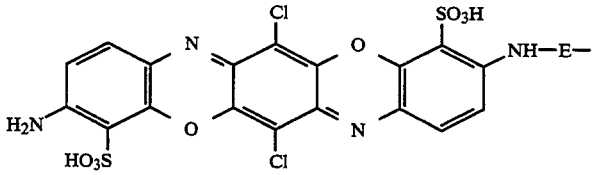

(5b)

wherein E is a phenylene radical which may be substituted by alkyl of 1 to 4 carbon atoms, halogen, carboxy or sulfo; or is an alkylene radical of 2 to 6 carbon atoms; and the outer benzene rings in formulae (5a) and (5b) can be further substituted by alkyl of 1 to 4 carbon atoms, alkoxy of 1 to 4 carbon atoms, acetylamino, nitro, halogen, carboxy or sulfo.

It is also particularly preferred to use dyes of formula (1), wherein D is the radical of an azo dye, preferably a radical of formulae 6 to 17:

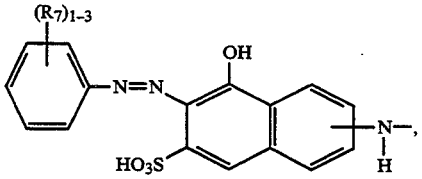

(6)

wherein $(R_7)_{1-3}$ denotes 1 to 3 substituents selected from the group consisting of $C_{1-4}$alkyl, $C_{1-4}$alkoxy, halogen, carboxy and sulfo;

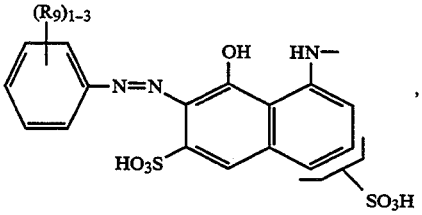

(7)

wherein $(R_9)_{1-3}$ denotes 1 to 3 substituents selected from the group consisting of $C_{1-4}$alkyl, $C_{1-4}$alkoxy, halogen, carboxy and sulfo;

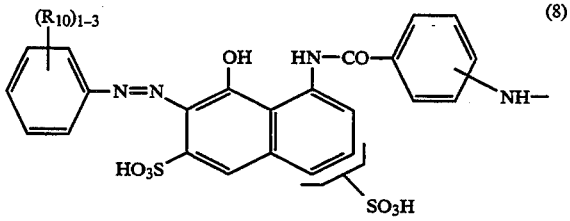

(8)

wherein $(R_{10})_{1-3}$ denotes 1 to 3 substituents selected from the group consisting of $C_{1-4}$alkyl, $C_{1-4}$alkoxy, halogen, carboxy and sulfo;

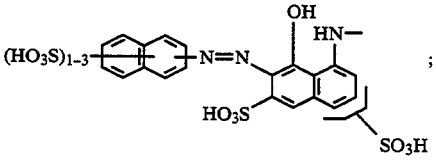

(9)

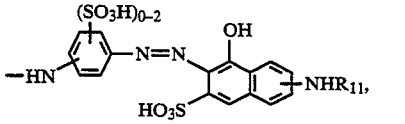

(10)

wherein $R_{11}$ is $C_{2-4}$alkanoyl or benzoyl;

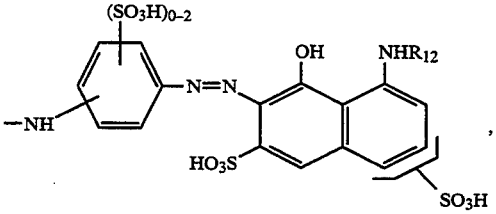

(11)

wherein $R_{12}$ is $C_{2-4}$alkanoyl or benzoyl;

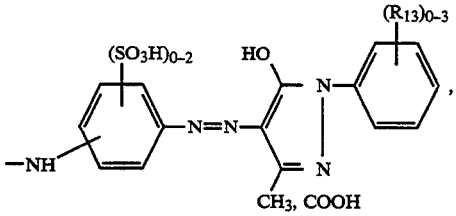

(12)

wherein $(R_{13})_{0-3}$ denotes 0 to 3 substituents selected from the group consisting of $C_{1-4}$alkyl, $C_{1-4}$alkoxy, halogen, carboxy and sulfo;

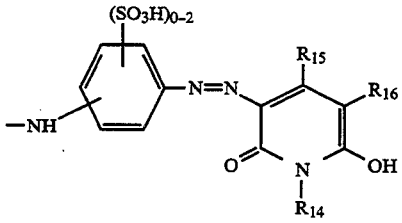

(13)

wherein $R_{14}$ and $R_{15}$ are each independently of the other hydrogen, $C_{1-4}$alkyl or phenyl, and $R_{16}$ is hydrogen, cyano, carbamoyl or sulfomethyl;

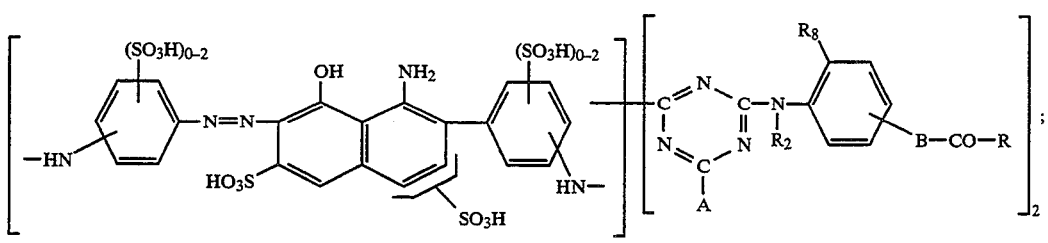

(14)

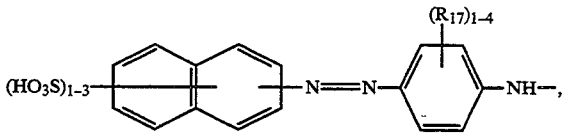

(15)

wherein $(R_{17})_{1-4}$ denotes 1 to 4 substituents selected from the group consisting of hydrogen, halogen, nitro, cyano, trifluoromethyl, sulfamoyl, carbamoyl, $C_{1-4}$alkyl, $C_{1-4}$alkoxy, amino, acetylamino, ureido, hydroxy, carboxy, sulfomethyl and sulfo, independently of one another;

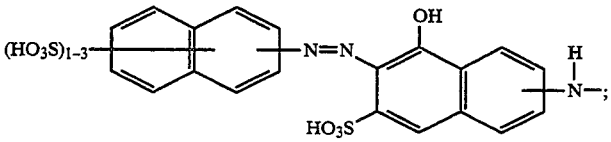

(16)

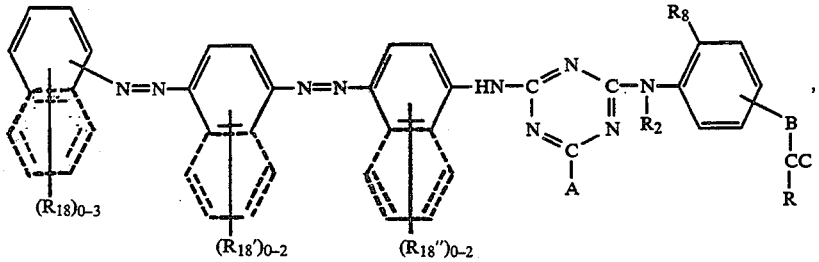

(17)

wherein $(R_{18})_{0-3}$, $(R_{18'})_{0-2}$ and $(R_{18''})_{0-2}$ are each independently of one another 0 to 3 or 0 to 2 substituents selected from the group consisting of $C_{1-4}$alkyl, $C_{1-4}$alkoxy and sulfo.

A further preferred embodiment of the novel process comprises the use of dyes of formula

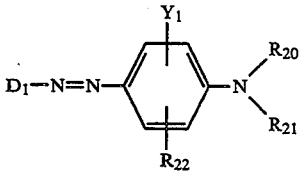

(20)

wherein $D_1$ is the radical of a carbocyclic or heterocyclic diazo component which is devoid of water-solubilising substituents;

$Y_1$ is chloro, methyl, methoxy, methoxyethyl, methoxyethoxy or hydrogen;

$R_{20}$ and $R_{21}$ are each independently of the other $C_1$-$C_6$alkyl, $C_3$-$C_6$alkenyl, phenyl or the radical $—B_1—X_1$;

$R_{22}$ is hydrogen, methyl, methoxy, chloro, bromo or the radical $X_1$;

$X_1$ is a radical containing a polymerisable double bond;

$B_1$ is an unsubstituted or substituted radical of formula $—(CH_2)_m—(C_6H_4)_n—(CH_2)_o—$;

wherein m is an integer from 1 to 6 n is 0 or 1 and o is an integer from 0 to 6;

and at least one of $R_{20}$, $R_{21}$ or $R_{22}$ has the meaning of $X_1$ or is substituted by a radical $X_1$.

$D_1$ is preferably the radical of a homocyclic or heterocyclic diazo component, conveniently selected from the series consisting of thienyl, phenylazothienyl, thiazolyl, isothiazolyl, 1,2,4-thiadiazolyl, 1,3,4-thiadiazolyl, benzothiazolyl, benzisothiazolyl, pyrazolyl, 1,2,3-triazolyl, 1,2,4-triazolyl, imidazolyl, and phenyl. Each of these systems can carry further substituents such as alkyl, alkoxy or alkylthio, each of 1 to 4 carbon atoms, phenyl, electronegative groups such as halogen, preferably chloro or bromo, trifluoromethyl, cyano, nitro, acyl, typically acetyl or benzoyl, carboalkoxy, preferably carbomethoxy or carboethoxy, alkylsulfonyl of 1 to 4 carbon atoms, phenylsulfonyl, phenoxysulfonyl, sulfamoyl or arylazo, preferably phenylazo. Two adjacent substituents of each of these ring systems may also together form fused rings, typically phenyl rings or cyclic imides.

Most preferably $D_1$ is a benzothiazolyl, benziso-thiazolyl or phenyl radical which is unsubstituted or substituted by one or two of the radicals cited above.

The alkyl radicals may be substituted, conveniently by hydroxy, alkoxy of 1 to 4 carbon atoms, preferably methoxy, cyano or phenyl. Further suitable substituents are halogen, typically fluoro, chloro or bromo, or —CO—U or —O—CO—U, wherein U is alkyl of 1 to 6 carbon atoms or phenyl.

Suitable alkenyl radicals are those which are derived from the above cited alkyl radicals by replacing at least one single bond by a double bond. Suitable alkenyl radicals are typically ethenyl or propenyl.

Phenyl radicals will be understood as meaning unsubstituted or substituted phenyl radicals. Suitable substituents may be $C_1$-$C_4$alkyl, $C_1$-$C_4$alkoxy, bromo, chloro, nitro or $C_1$-$C_4$alkylcarbonyl amino.

The radical $X_1$ may suitably be a radical derived from acrylic, methacrylic or cinnamic acid. To be singled out for special mention are the radicals of formula —NH—CO—CH=$CH_2$, —NH—CO—C($CH_3$)=$CH_2$, —NH—CO—CBr=$CH_2$, —NH—CO—CH=CH—$C_6H_5$, —O—CO—CH=$CH_2$, —O—CO—C($CH_3$)=$CH_2$, —O—CO—CBr=$CH_2$, —O—CO—CH=CH—$C_6H_5$, —CH=$CH_2$, —CH=CH—$C_6H_5$ or —C($CH_3$)=$CH_2$.

Especially preferred dyes are those of formulae:

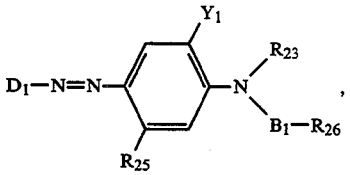

(21)

-continued

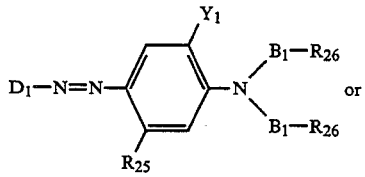

(22)

or

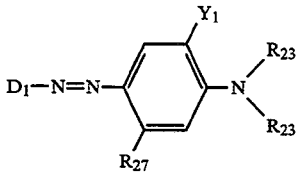

(23)

wherein $R_{23}$ is $C_1$-$C_6$alkyl, $C_3$-$C_6$alkenyl or phenyl;

$R_{25}$ is hydrogen, methyl, methoxy, chloro, bromo, —NH—CO—CH=$CH_2$, —NH—CO—C($CH_3$)=$CH_2$, —NH—CO—CBr=$CH_2$, —NH—CO—CH=CH—$C_6H_5$, —O—CO—CH=$CH_2$, —O—CO—C($CH_3$)=$CH_2$, —O—CO—CBr=$CH_2$, or —O—CO—CH=CH—$C_6H_5$;

$R_{26}$ is —NH—CO—CH=$CH_2$, —NH—CO—C($CH_3$)=$CH_2$, —NH—CO—CBr=$CH_2$, —NH—CO—CH=CH—$C_6H_5$, —O—CO—CH=$CH_2$, —O—CO—C($CH_3$)=$CH_2$, —O—CO—CBr=$CH_2$ or —O—CO—CH=CH—$C_6H_5$; and $R_{27}$ is —NH—CO—CH=$CH_2$, —NH—CO—C($CH_3$)=$CH_2$, —NH—CO—CBr=$CH_2$ or —NH—CO—CH=CH—$C_6H_5$, and wherein $B_1$, $D_1$ and $Y_1$ are as defined for formula (20).

Representative examples of the above dyes are dyes of formulae:

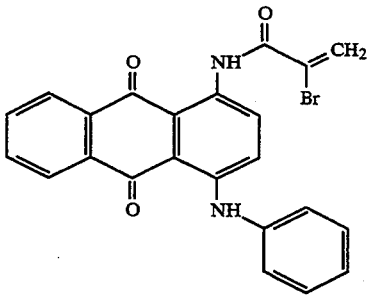

(40)

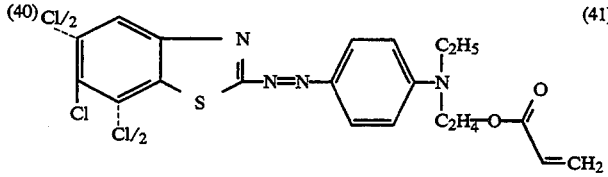

(41)

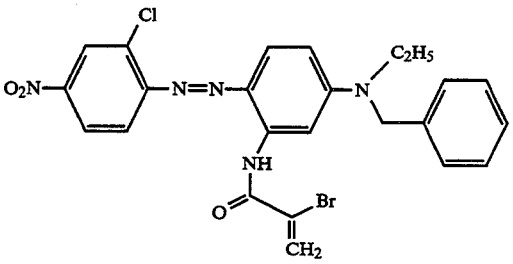

(42)

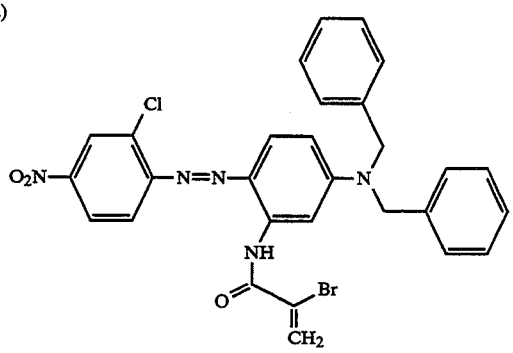

(43)

-continued (44)

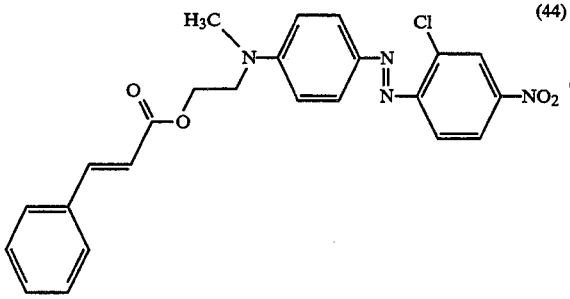

(45)

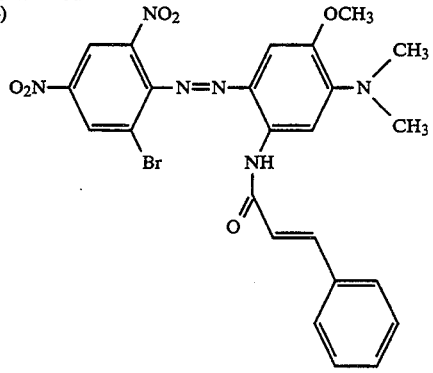

The above dyes are known or they can be prepared by known methods, typically by reacting a solution of the compound to be acylated in anhydrous acetone with about one molar equivalent of an acryloyl chloride. Then about one molar equivalent of pyridine is added at room temperature and the product is precipitated by addition of water.

The colourless organic compounds which contain at least one polymerisable double bond used in the inventive process are those which are devoid of chromophoric radicals. They are organic monomers, oligomers or polymers, or a mixture thereof, which can be polymerised or crosslinked when subjected to ionising radication.

The colourless compounds preferably used in the novel process are acrylates, diacrylates, acrylic acid or acrylamides.

It is particularly preferred to use mixtures of colourless organic monomers and oligomers in the process of this invention.

A suitable organic monomer is one having a molecular weigt of up to c. 1000 and containing at least one polymerisable group.

Bi-, tri- and polyfunctional monomers are also suitable.

The colourless monomer can be used direct not only by itself but also in admixture with other monomers, oliogomers and/or polymers.

A suitable colourless oligomer is one having a molecular weight in the range from 1000 to 10 000 and containing one or more polymerisable groups. If in liquid form, the colourless oligomer can be used by itself direct or as a solution in water or organic solvents or in admixture with other monomers, oligomers and/or polymers.

A suitable colourless polymer is one having a molecular weight of >10 000 and containing one or more polymerisable groups.

If in liquid form, the colourless polymer can be used by itself direct or as a solution in water or organic solvents or in admixture with other monomers, oligomers and/or polymers.

Suitable colourless compounds are ethylenically unsaturated monomers, oligomers and polymers.

Particularly suitable colourless compounds include esters of ethylenically unsaturated carboxylic acids and polyols or polyepoxides, and polymers containing ethylenically unsaturated groups in the chain or in side groups, typically unsaturated polyesters, polyamides and polyurethanes and copolymers thereof, polybutadiene and butadiene copolymers, polyisoprene and isoprene copolymers, polymers and copolymers containing (meth)acryloyl groups in side chains as well as mixtures of one or more such polymers.

Examples of unsaturated carboxylic acids are acrylic acid, methacrylic acid, crotonic acid, itaconic acid, cinnamic acid, and unsaturated fatty acids such as linolenic acid or oleic acid. Acrylic acid and methacrylic acid are preferred.

Suitable polyols are aliphatic and cycloaliphatic polyols. Polyepoxides are typically those based on polyols and epichlorohydrin. Suitable polyols are also polymers or copolymers which contain the hydroxyl groups in the polymer chain or in side groups, including polyvinyl alcohol and copolymers thereof, or hydroxylalkyl polymethacrylates or copolymers thereof. Further suitable polyols are oligoesters carrying hydroxyl end groups.

Exemplary of aliphatic and cycloaliphatic polyols are alkylene diols containing preferably 2 to 12 carbon atoms, including ethylene glycol, 1,2- or 1,3-propanediol, 1,2-, 1,3- or 1,4-butanediol, pentanediol, hexanediol, octanediol, dodecanediol, diethylene glycol, triethylene glycol, polyethylene glycols having molecular weights of preferably 200 to 1500, 1,3-cyclopentanediol, 1,2-1,3-or 1,4-cyclohexanediol, 1,4-dihydroxymethylcyclohexane, glycerol, tris(β-hydroxyethyl)amine, trimethylolethane, trimethylolpropane, pentaerythritol, dipentaerythritol and sorbitol.

The polyols may be partially or completely esterified with one carboxylic acid or with different unsaturated carboxylic acids. The free hydroxyl groups of partial esters can be modified, for example esterified, or esterified with other carboxylic acids.

Representative examples of esters are: trimethylolpropane triacrylate, trimethylolethane triacrylate, trimethylolpropane trimethacrylate, trimethylolethane trimethacrylate, tetramethylene glycol dimethacrylate, triethylene glycol dimethacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentaacrylate, dipentaerythritol hexaacrylate, tripentaerythritol octaacrylate, pentaerythritol dimethacrylate, pentaerythritol trimethacrylate, dipentaerythritol dimethacrylate, dipentaerythritol tetramethacrylate, tripentaerythritol octamethacrylate, pentaerythritol diitaconate, dipentaerythritol trisitaconate, dipentaerythritol pentaitaconate, dipentaerythritol hexaitaconate, ethylene glycol dimethacrylate, 1,3-butanediol diacrylate, 1,3-butanediol dimethacrylate, 1,4-butanediol diitaconate, sorbitol triacrylate, sorbitol tetraacrylate, pentaerythritol-modified triacrylate, sorbitol tetramethacrylat, sorbitol pentaacrylate, sorbitol hexaacrylate, oligoester acrylates and methacrylates, glycerol di-and triacrylate, 1,4-cyclohexane diacrylate, bisacrylates and bismethacrylates of polyethylene glycol having a molecular weight of 200–1500, or mixtures thereof.

Suitable colourless compounds are also the amides of identical or different unsaturated carboxylic acids of aromatic, cycloaliphatic and aliphatic polyamides containing preferably 2 to 6, more particularly 2 to 4, amino groups. Exemplary of such polyamines are ethylenediamine, 1,2- or 1,3-propylenediamine, 1,2-, 1,3- or 1,4-butylenediamine, 1,5-pentylenediamine, 1,6-hexylenediamine, octylenediamine, dodecylenediamine, 1,4-diaminocyclohexane, isophoronediamine, phenylenediamine, bisphenylenediamine, bis($\beta$-aminoethyl) ether, diethylenetriamine, triethylenetetramine, bis($\beta$-aminoethoxy)ethane or bis($\beta$-aminopropoxy)ethane. Further suitable polyamines are polymers and copolymers containing amino groups in the side chain and oligoamides carrying amino end groups.

Such unsaturated amides include: methylenebisacrylamide, 1,6-hexamethylenebisacrylamide, diethylenetriaminetris(methacrylamide), bis(methacrylamidopropoxy)ethane, $\beta$-methacrylamidoethylmethacrylate, N[($\beta$-hydroxyethoxy)ethyl]acrylamide.

Suitable unsaturated polyesters and polyamides may be derived from maleic acid and diols or diamines. The maleic acid may be partially replaced by other dicarboxylic acids. They can be used together with ethylenically unsaturated comonomers, conveniently styrene. The polyesters and polyamides may also be derived from dicarboxylic acids and ethylenically unsaturated diols or diamines, especially from those having long chains of typically 6 to 20 carbon atoms. Polyurethanes are typically those which are derived from saturated or unsaturated diisocyanates and unsaturated or saturated diols.

Polybutadiene and polyisoprene and copolymers thereof are known. Suitable comonomers are typically olefins including ethylene, propene, butene, hexene, (meth)acrylates, acrylonitrile, styrene or vinyl chloride. Polymers containing (meth)acrylate groups in the side chain are also known. They may be reaction products of epoxy resins derived from novolaks with (meth)acrylic acid, homopolymers or copolymers of polyvinyl alcohol or the hydroxyalkyl derivatives thereof which are esterified with (meth)acrylic acid, or homopolymers and copolymers of (meth)acrylates which are esterified with hydroxyalkyl (meth)acrylates.

The colourless compounds may be used singly or in any mixtures with one another.

Suitable colourless oligomers or polymers are preferably different polyester acrylates, typically $CH_2{=}CH{-}[CO{-}O(CH_2)_n]{-}CO{-}O{-}CH{=}CH_2$, epoxy acrylates, typically $(CH_2{=}CH{-}CO{-}O{-}CH_2{-}CHOH{-}CH_2{-}O{-}C_6H_6)_2C(CH_3)_2$, urethane acrylates, typically $$CH_2{=}CH{-}CO{-}O{-}[CH_2{-}\underset{\underset{CH_3}{|}}{CH}{-}O]_n{-}CO{-}O{-}CH{=}CH_2,$$

and silicone acrylates, as known from Textilpraxis International (1987), pages 848–852.

A preferred embodiment of the inventive process comprises using as colourless compounds those containing the acryloyl radical as polymerisable group, oligomeric polyether, polyurethane and polyester acrylates being especially preferred.

In the process of this invention it is preferred to use a colourless monomer selected from the group consisting of N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, butanediol acrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromacrylamide, methylenebisdi(bromacrylamide), methylenebisdiacrylamide, N-alkoxyacrylamide, tetraethylene glycol diacrylate, soybean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, bis(trimethylolpropane)tetraacrylate, tris(2-hydroxyethyl)isocyanurate triacrylate, isodecyl acrylate, dipentaerythritol pentaacrylate, ethoxylated trimethylolpropane triacrylate, isobornyl acrylate, ethoxylated tetrabromobisphenol diacrylate, propoxylated neopentyl glycol diacrylate, propoxylated glyceryl triacrylate.

To prepare solutions of sparingly soluble or water-insoluble dyes it is especially preferred to use oligoethylene glycol diacrylates (mol. wt. ~500), N-vinylpyrrolidone, 2-ethyl-(2-hydroxymethyl)-1,3-propanediol triacrylate, alkoxylated oligoether polyol tetraacrylate, oligoether triacrylate, N-butoxyacrylamide, N-isobutoxyacrylamide, mixtures thereof with one another as well as mixtures thereof with methylenebisacrylamide, oligo/polyurethane acrylate, oligo/polyester acrylate or oligo/polyether acrylate.

To prepare aqueous emulsions of sparingly soluble or water-insoluble dyes it is especially preferred to use alkoxylated oligoether polyol tetraacrylate, 2-ethyl-(2-hydroxymethyl)-1,3-propanediol triacrylate, oligo/polyurethane acrylate, oligo/polyester acrylate, oligo/polyether acrylate, mixtures thereof with one another as well as mixtures thereof with methylenebisacrylamide, oligoethylene glycol diacrylates (mol. wt. ~500), N-vinylpyrrolidone, oligoether triacrylate, N-butoxyacrylamide or N-isobutoxyacrylamide.

$$\begin{array}{l} CH_2{=}CH{-}CO{-}O{-}CH_2CH_2{-}O{-}CO{-}NH{-}(CH_3){-}C_6H_3{-}NH{-}CO{-}O{-}(CH_2)_6{-}CO \\ \qquad\qquad\qquad\

The novel process is applicable to the most diverse organic materials, including textile material, paper, wood, leather and plastics. Fibre materials are preferred, inclusding fibres of animal origin such as wool, silk, hairs (e.g. as felt) or regenerated fibres such as protein fibres or alginate fibres, man-made fibres, including polyvinyl, polyacrylonitrile, polyester, polyamide or polyurethane fibres, polypropylene and, more particularly, cellulosic materials such as bast fibres, including linen, hemp, jute, ramie and, preferably, cotton, as well as cellulosic fibres such as viscose or modal fibres, copper, nitrate or saponified acetate fibres, or cellulose acetate fibres, for example secondary acetate fibres, or cellulose triacetate fibres such as Arnel®, Trilan®, Courpleta® or Tricel®. It is particularly preferred to apply the novel process to cellulosic fibres, including cotton or viscose rayon and blends thereof with polyester, polyacrylonitrile, polyamide or polypropylene fibres.

The above fibres can be in any of the forms of presentation used especially in the textile industry, typically filaments, yarns, woven fabrics, knitted fabrics or nonwovens such as felts.

The application of dye and colouress compound can be made together as homogeneous solution, suspension, emulsion or foam using standard processes. However, dye and colourless compound or some of the colourless compound can be applied separately. Thus, for example, an aqueous solution of the dye is padded on to the material first and then, after drying the dyeing, the colourless compound may be applied by spraying.

The novel process is carried out by passing the dyed textile material which has been treated with a solution of a colourless compound, in the dry state at room temperature, through the spread beam of an electron accelerator. The speed at which the material is passed through the beam is such that a radiation dose of specific intensity is achieved. The radiation doses normally employed are in the range from 0.1 to 15 Mrad, but the radiation dose is preferably in the range from 0.1 to 4 Mrad. At a dose of less than 0.1 Mrad the fixation is usually insufficient, whereas at a dose of more than 15 Mrad the fibre material and the dye suffer damage. The concentrations of the dye solutions or print pastes can be chosen as in conventional dyeing and printing processes, conveniently 0.001 to 10 percent by weight, based on the fibre material. After the treatment by ionising radiation, the material need only be washed and dried. Dye fixation is high, typically more than 75%. The dyeings obtained in the novel process have good allround fastness properties, including good wash- and lightfastness.

When carrying out the novel process, regard must naturally be had to the particular technical requirements. Thus the special embodiment of the process will depend in particular on the kind of ionising beams used for radiation and on how they are produced. If it is desired, for example, to irradiate a roll of yam impregnated with dye solution and a solution of the colourless compound with $\gamma$-rays, then said roll is subjected to radiation sealed in a cell. If higher radiation doses are desired at a lower radiation intensity, the material can be subjected to radiation in several passes.

To prevent destructive oxidation of the dye, it is useful to carry out the irradiation in an inert gas atmosphere, conveniently under nitrogen.

A preferred embodiment of the invention comprises carrying out both fixation of the fibre material with appropriate dyes as well as dyeing or printing continuously.

In the following working Examples, the radiation doses are normally expressed in Mrad (megarad), 1 rad corresponding to an absorption of $10^{-2}$ J/kg (joule/kg).

The fabric specified in the following Examples is printed on one side or dyed by the pad-batch process and irradiated in an inert gas atmopshere with accelerated electrons (voltage ~165 kV). Prints are irradiated on one side, dyeings on both sides in two passes. After irradiation, the dyeings and prints are given the conventional washing off for reactive dyes.

The fixation percentages are determined by removing the dye from an irradiated and unwashed sample and a non-irradiated sample. The samples are treated once in 50 ml of a solution of 600 ml/l of phosphate buffer (pH 7) and 40 ml/l of tetramethylurea in deionised water at 40° C. and then with with 50 ml of this solution for 30 minutes at 100° C. Both extracts are combined and the percentage fixation is determined via the extinction (at $\lambda_{max}$). In Examples 6 and 7, the extraction is made in the same manner with dimethyl formamide.

EXAMPLE A

A mixture of the 5,6- and 6,7-dichloro-2-aminobenzothiazole isomers is diazotised in conventional manner and coupled to N-ethyl—N-hydroxyethylaniline, to give the dye of formula

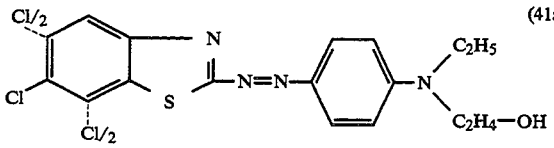

(41a)

4 g of this dye are dissolved in 50 ml of anhydrous acetone. After addition of 1 g of acryloyl chloride, 0.8 g of anhydrous pyridine is added dropwise at room temperature. The mixture is stirred for 1 hour and then the product is precipitated by adding 500 ml of water to the solution. The black, slightly tacky product of formula

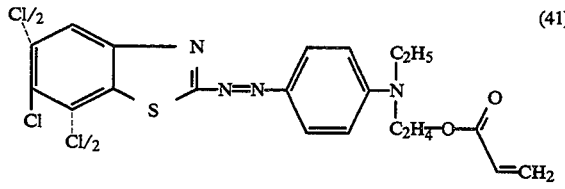

(41)

is isolated by filtration.

EXAMPLE 1

A cotton satin fabric is padded (liquor pick-up c. 70% ) with an aqueous solution which contains 30 g/l of the dye of formula

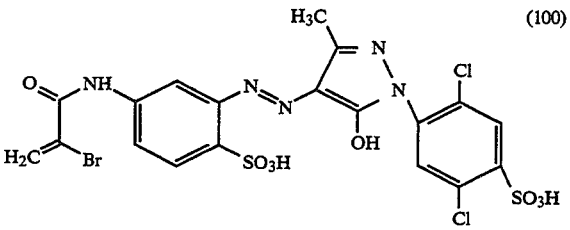

(100)

100 g/l of an oligoethylene glycol diacrylate and 100 g/l of urea (liquor pick-up c. 70%). The fabric is dried at c. 60°-80° C. and then irradiated on both sides with accelerated electrons with a dose of 4 Mrad per side, to give a yellow dyeing with superior fastness properties. The dye fixation is 71%.

EXAMPLE 2

Following the procedure described in Example 1, a cotton satin fabric is dyed with an aqueous solution which contains 30 g/l of the dye of formula

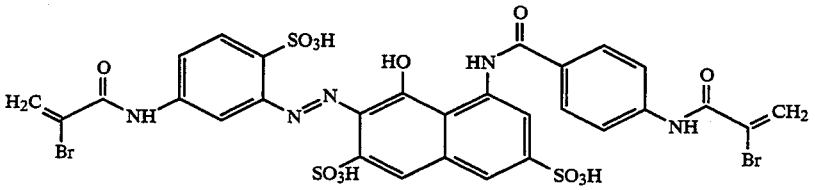

(101)

and then dried and irradiated, to give a red dyeing with superior fastness properties. The dye fixation is 75%.

EXAMPLE 3

Following the procedure described in Example 1, a cotton satin fabric is dyed with an aqueous solution which contains 30 g/l of the dye used in Example 2, 50 g/l of an oligoethylene glycol diacrylate, 50 g/l 2-ethyl-(2-hydroxymethyl)-1,3-propanediol triacrylate and 100 g/l of urea, and then dried and irradiated, to give a red dyeing with superior fastness properties. The dye fixation is 64%.

EXAMPLE 4

Following the procedure described in Example 1, a cotton satin fabric is dyed with an aqueous solution which contains 30 g/l of the dye used in Example 2, 50 g/l of an oligoethylene glycol diacrylate, 50 g/l of methylenebisacrylamide and 100 g/l of urea, and then dried and irradiated, to give a red dyeing with superior fastness properties. The dye fixation is 67%.

EXAMPLE 5

Following the procedure described in Example 1, a cotton satin fabric is dyed with an aqueous solution which contains 30 g/l of the dye used in Example 2, 50 g/l of an oligoethylene glycol diacrylate, 50 g/l of an oligoether triacrylate and 100 g/l of urea, and then dried and irradiated, to give a red dyeing with superior fastness properties. The dye fixation is 63%.

EXAMPLE 6

A cotton satin fabric is padded (liquor pick-up c. 70% ) with an aqueous solution which contains 30 g/l of the dye used in Example 2, 75 g/l of an oligourethane diacrylate, 50 g/l of methylenebisacrylamide and 100 g/l of urea. The fabric is dried and then irradiated on both sides with accelerated electrons with a dose of 4 Mrad per side, to give a red dyeing with a dye fixation of 73%.

EXAMPLE 7

A cotton satin fabric is padded (liquor pick-up c. 70%) with an aqueous solution which contains 30 g/l of the dye used in Example 2, 75 g/l of an oligourethane diacrylate, 100 g/l of an oligoethylene glycol diacrylate and 100 g/l of urea. The fabric is dried and then irradiated on both sides with accelerated electrons with a dose of 4 Mrad per side, to give a red dyeing with a dye fixation of 77%.

EXAMPLE 8

A cotton satin fabric is padded (liquor pick-up c. 70%) with an aqueous solution which contains 30 g/l of the dye used in Example 2 and 100 g/l of urea. The fabric is then padded (liquor pick-up c. 40% ) with a solution in ethanol of 10 g/kg of 1,6-hexanediol diacrylate, 90 g/kg of an oligomeric aliphatic urethane diacrylate and 100 g/kg of an oligoethylene glycol diacrylate. The fabric is dried and then irradiated on both sides with accelerated electrons with a dose of 4 Mrad per side, to give a red dyeing with a dye fixation of 72%.

What is claimed is:

1. A process for dyeing, which comprises applying a dye, which dye contains at least one polymerisable double bond or at least one polymerisable ring system, and a colourless compound or a mixture of colourless compounds, which colourless compound contains at least one polymerisable double bond, to a fiber material, drying the fiber material to a residual moisture content of less than 20% and subjecting the fiber material to ionizing radiation.

2. A process according to claim 1, wherein the colourless compound is a monomeric, oligomeric or polymeric organic compound or a mixture thereof.

3. A process according to claim 1, wherein the colourless compound is an acrylate, a diacrylate or acrylic acid.

4. A process according to claim 1, wherein the colourless compound is a mixture of monomeric and oligomeric colourless organic compounds.

5. A process according to claim 2, wherein the colourless compound includes one or more monomeric colouress compounds having a molecular weight of up to 1000.

6. A process according to claim 2, wherein the colourless compound includes one or more oligomeric colourless compounds having a molecular weight in the range from 1000 to 10 000.

7. A process according to claim 1, wherein the colourless compound contains a polymerisable acryl radical.

8. A process according to claim 7, wherein the colourless compound used is an oligomeric polyether, polyurethane or polyester acrylate.

9. A process according to claim 1, wherein the colouress compound is selected from the group consisting of N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, butanediol acrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromacrylamide, methylenebisdi(bromacrylamide), methylenebisdiacrylamide, N-alkoxyacrylamide, tetraethylene glycol diacrylate, soybean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, bis(trimethylolpropane)tetraacrylate, tris(2-hydroxyethyl)isocyanurate triacrylate, isodecyl acrylate, dipentaerythritol pentaacrylate, ethoxylated trimethylolpropane triacrylate, isobornyl acrylate, ethoxylated tetrabromobisphenol diacrylate, propoxylated neopentyl glycol diacrylate, propoxylated glyceryl triacrylate.

10. A process according to claim 1, wherein the colourless compound is selected from the group consisting of N-vinylpyrrolidone, methylenebisacrylamide or bisacrylates of polyethylene glycol having a molecular weight in the range from 200 to 1500.

11. A process according to claim 1, wherein the dye is a dye of formula $$D—(X)_m \quad (1),$$

wherein D is the radical of an organic dye of the monoazo or polyazo series, of the metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series, X is a radical containing a polymerisable double bond or a polymerisable ring system, and m is 1, 2, 3, 4, 5 or 6.

12. A process according to claim 1, wherein the dye contains a polymerisable acryloyl, α-bromacryloyl, α-chloracryloyl, vinylsulfonyl or epoxidyl radical.

13. A process according to claim 12, wherein the dye contains a polymerisable acryloyl, α-bromacryloyl or vinylsulfonyl radical.

14. A process according to claim 1, wherein the ionising radiation is carried out with electron beams produced in a particle accelerator.

15. A process according to claim 1, wherein the dyes are applied to the fibre material by dyeing or printing.

16. A process according to claim 1, wherein from 0.1 to 15 Mrad of ionizing radiation is applied to the fiber material.

17. A process according to claim 1, wherein the irradiation is carried out in an inert gas atmosphere.

18. A process of claim 1 which is a continuous process.

19. A process according to claim 1, wherein both the fixation and the dyeing or printing are carried out continuously.

20. A process according to claim 1, wherein the fibre material is selected from the group consisting of wool, silk, hairs, alginate fibres, polyvinyl, polyacrylonitrile, polyester, polyamide, polypropylene or polyurethane fibres, cellulosic fibres and glass fibres.

21. A process according to claim 1, wherein the fibre material is dyed or printed cellulose containing fibres or cellulosic fibres.

22. A process according to claim 1, wherein the fibre material is a polyester/cellulose blend.

23. The dyed or printed fibre material which is fixed by the process of claim 1.

* * * * *